United States Patent [19]

Torigai

[11] 4,297,969

[45] Nov. 3, 1981

[54] MAGNETIC POWDER TRANSPORTING DEVICE

[75] Inventor: Akiyoshi Torigai, Machida, Japan

[73] Assignee: Canon Kabushiki Kaisha, Tokyo, Japan

[21] Appl. No.: 89,369

[22] Filed: Oct. 30, 1979

[30] Foreign Application Priority Data

Nov. 10, 1978 [JP] Japan ..... 53-137834

[51] Int. Cl.[3] ..... G03G 15/06

[52] U.S. Cl. ..... 118/652; 118/657; 118/658

[58] Field of Search ..... 118/657, 658, 652

[56] References Cited

U.S. PATENT DOCUMENTS

| | | | |
|---|---|---|---|
| 3,233,587 | 2/1966 | Morton | 118/657 |
| 3,402,698 | 9/1968 | Kojima et al. | 118/658 |
| 3,437,074 | 4/1969 | Hagopian et al. | 118/658 |
| 3,659,311 | 5/1972 | Waren | 118/657 |
| 3,665,891 | 5/1972 | Pitasi | 118/658 |
| 3,939,801 | 2/1976 | Tanaka et al. | 118/658 |

OTHER PUBLICATIONS

IBM Tech. Dis. Bull. vol. 17, No. 9, 2-75, Ellis, 118-657, p. 2693.

IBM Tech. Dis. Bul. vol. 17, No. 9, 2-75, Knight, 118-658, pp. 2684-2686.

*Primary Examiner*—Bernard D. Pianalto

*Attorney, Agent, or Firm*—Fitzpatrick, Cella, Harper & Scinto

[57] ABSTRACT

A magnetic powder transporting device for use in a developing or cleaning unit in an image forming apparatus such as an electrophotographic copier or magnetic printer. A magnet functioning as the transporting means is provided at the ends thereof with magnetic field generating portions for magnetically displacing the magnetic powder toward the inner position. Said magnetic field generating portions are formed by inclined end portions of main magnetic poles or by auxiliary magnetic poles separate from said main magnetic poles.

14 Claims, 9 Drawing Figures

MAGNETIC POWDER TRANSPORTING DEVICE

BACKGROUND OF THE INVENTION

1. Field of the Invention

The present invention relates to a magnetic powder transporting device, and more particularly to such device capable of preventing the magnetic powder scattering.

2. Description of the Prior Art

As an example of the magnetic powder transporting device there is already known a sleeve-type developing unit for powdered toner for use in the electrophotographic copier, for example disclosed in the U.S. Pat. No. 4,091,765. The abovementioned device is composed of a magnet roller provided on the peripheral surface thereof with magnets and a non-magnetic sleeve covering said peripheral surface, wherein said magnet roller and sleeve being maintained in mutual rotation to transport the powdered toner to a developing area where an electrostatic latent image on a photosensitive member is rendered visible. In said device the toner transportation is achieved either indirectly by iron powder carrier in case of two-component toner consisting of iron powder and toner particles, or directly by the toner particles in case of one-component toner consisting solely of toner particles having iron cores. Said toner transportation is conducted to replenish new toner to the developing area in which the toner is consumed.

The above-mentioned sleeve-type developing unit is advantageous in the significantly smaller weight and dimension in comparison with the cascade developing unit for example disclosed in the U.S. Pat. No. 2,573,881, but is associated with a drawback of causing toner scattering from the lateral ends of the developing area, thus severely soiling the interior of the copier. In the above-mentioned cascade developing unit, the toner particles transported to the developing area are subjected merely to gravity and not influenced by any external force towards the lateral ends of the developing area. In contrast, in the sleeve-type developing unit, the toner particles supported on the sleeve in spicate forms are spread, upon contact with the surface of the photosensitive member, over said surface, thus reaching the lateral ends of the developing area. Said toner spreading, functioning as a partial force toward the lateral ends of the developing area, naturally affects the toner particles present in said lateral end regions where the magnetic field ends, thereby releasing said toner particles from the magnetic field and causing the toner scattering.

The toner scattering is also caused by a fact that, although the magnetic field around the periphery of the sleeve is formed between the adjacent magnetic poles and is generally parallel to the plane perpendicular to the axis of the sleeve whereby the toner particles are scarcely subjected to axial force, the magnetic field at the lateral ends thereof is directed along the axis of the sleeve, thus causing the displacement of toner particles in said direction and facilitating the toner scattering.

In the conventional device as shown in FIGS. 1 and 2 respectively giving a partial view of the sleeve-type developing unit and a partial perspective view of the magnet roller, the toner particles T captured and transported on the surface of a sleeve 2 by a magnet roller 1 are shaped in almost vertical spicate forms over the approximately entire surface of said sleeve 2 until they come into contact with the surface of the photosensitive member 3, but said spicate forms are spread in lateral directions upon such contact. The magnetic field formed on the magnet roller 1 is mostly parallel to the plane perpendicular to the axis of the magnet roller as shown by the arrow A in FIGS. 1 and 2, but at the end portions of the roller there are formed magnetic fields in the axial direction as shown by the line B. (Although the magnetic field at the end portions is in fact complicated, there are only shown the lines in the axial direction for simplicity.) For this reason the toner particles T spread in the above-explained manner are subjected, at the end portions of the magnet roller 1, to the axial force along the magnetic field B, thus easily leaving the end faces of the roller and causing the toner scattering.

SUMMARY OF THE INVENTION

The object of the present invention is to provide an improved magnetic powder transporting device.

Another object of the present invention is to provide a magnetic powder transporting device capable of preventing the magnetic powder scattering from the end portion of the magnetic field of the magnetic powder transport means.

Still another object of the present invention is to provide a magnetic powder transporting device effective for preventing the magnetic powder scattering in the developing unit of an image forming apparatus.

Still another object of the present invention is to provide a magnetic powder transporting device effective for preventing the magnetic powder scattering in the cleaning unit of an image forming apparatus.

The above-mentioned objects of the present invention are achieved by a magnetic powder transporting device comprising transport means provided with a magnet having principal magnetic poles for transporting the magnetic powder drive means for driving said transport means, and magnetic field generating portions provided at the end portions of said magnet for magnetically displacing the magnetic powder toward the inside portion of said magnet.

DESCRIPTION OF THE PREFERRED EMBODIMENTS

The present invention, though applicable to any image forming apparatus including copiers or laser beam printers utilizing an electrostatic latent image formed on a photosensitive or insulating member and magnetic printers utilizing a magnetic latent image, will be clarified in detail in the following description by the embodiments applied to the developing unit and the cleaning unit of an electrophotographic copier.

In the following description it is assumed for simplicity that the transporting device is of a sleeve-type composed of a fixed sleeve and a rotatable magnet and utilizing one-component magnetic toner of the afore-mentioned type. However, the present invention is naturally applicable to any other types in which the sleeve and the magnet perform mutual displacement, for example a type composed of a rotatable sleeve and a fixed magnet or a type in which the sleeve and the magnet are both rotatable with different speeds, and also to the aforementioned two-component toner.

Figure 3:
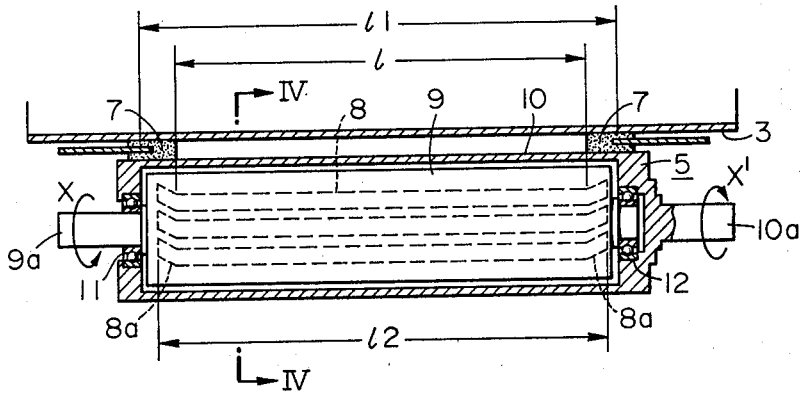
FIG. 3 is a longitudinal cross-sectional view of an embodiment of the present invention applied to the sleeve-type developing unit.
Figure 4:
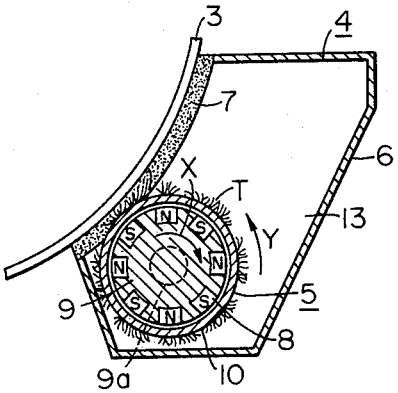
FIG. 4 is a cross-sectional view along the line IV—IV in FIG. 3.

Now referring to FIG. 3 showing a longitudinal cross-sectional view of an embodiment of the present invention applied to a sleeve-type developing unit and FIG. 4 showing a cross-sectional view thereof along the line IV—IV in FIG. 3, there is shown in a sleeve-type developing unit 4 for rendering visible a latent image formed on a photosensitive member 3, said developing unit comprising a casing 6 housing sleeve-type transport means 5 and a seal member 7 for substantially sealing the gap between said casing 6 and the photosensitive member 3. Said sleeve-type transport means 5 is provided with a magnet roller 9 having a magnet 8 (principal magnetic poles) arranged in such a manner that the different magnetic poles alternate along the peripheral surface and a sleeve 10 of a non-magnetic material for covering the periphery of said magnet roller 9, said magnet roller 9 and sleeve being arranged coaxially and rendered mutually rotatable by means of bearings 11, 12. The shafts 9*a*, 10*a* of the magnet roller 9 and sleeve 10 are supported by side plates 13 of the casing 6. In an embodiment with fixed sleeve and rotatable magnet the magnet roller shaft 9*a* is driven by unrepresented drive means while the sleeve shaft 10*a* is rendered stationary, and vice versa in an embodiment with rotatable sleeve and fixed magnet.

Figure 5:
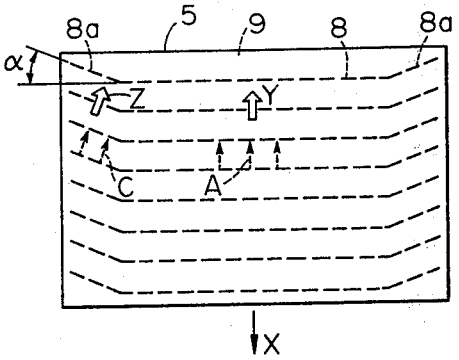
FIG. 5 is a developed view of the sleeve-type transport means 5.

As shown in FIGS. 3 and 5, the magnetic poles of said magnet roller are positioned parallel to the axis thereof in an area corresponding to or somewhat wider than the image area b but are bent in one direction in the end portions outside said area to form inclined portions 8*a* with an acute angle $\alpha$ with respect to the axis of said magnet roller, whereby the magnetic field C formed thereby is likewise directed with an acute angle with respect to said axis to generate a force for displacing the toner particles toward the internal portion of the magnet roller. Upon rotation of the magnet roller 9 in a direction X shown in FIG. 3, the toner particles on the sleeve 10 are displaced, as shown in FIG. 5, in a direction Y parallel to the magnetic field A in the image area. On the other hand, outside said image area, the toner particles are displaced, by means of the inclined portions 8*a* of the magnetic poles 8, in a direction Z along the magnetic field C inwardly toward the image area, thus avoiding the toner scattering at the end portions of the magnet roller. In case of a unit with rotatable sleeve and fixed magnet, a similar inward displacement of toner particles can be realized by rotating the sleeve in a direction X' in FIG. 3. In this case the toner particles macroscopically revolves integrally with the sleeve in the direction X' and at the same time rotates microscopically in the direction X' (or direction Y in FIG. 4). Also in this type of unit with rotatable sleeve the mutual displacement between the sleeve and magnet is same as shown in FIG. 5 so that the magnet displaces in the direction X with respect to the sleeve, whereby the toner particles present in the inclined portions of the magnetic poles show a similar behavior as in the unit with fixed sleeve and rotatable magnet.

Although FIG. 5 depicts only the lines of magnetic field perpendicular to the magnetic poles 8, there in fact exist those diagonal to said poles 8. However the toner particles are controlled principally by those perpendicular to the magnetic poles, since the perpendicular direction offers the minimum displacing distance and the diagonal lines of magnetic field are mutually cancelled.

It is already known, from the aforementioned the U.S. Pat. No. 4,091,765, that the toner particles on the non-magnetic sleeve are displaced in a direction opposite to the displacing direction of the magnetic field.

The present invention, when applied to the developing unit as explained in the foregoing, provides the following advantages.

The charging device for providing the photosensitive member 3 with an electrostatic charge necessary for the latent image formation has a charging area b1 which is usually wider, by 5 to 10 mm, than the image area b as shown in FIG. 3, in consideration of the attenuation of the charged potential at the edge portions of said charging area. Also in the developing unit the magnet roller is structured to have a developing area b2 which is wider, by approximately 5 mm' than said image area, in consideration of the decrease in height of the spicate formed toner particles at the end portions of the magnet roller.

Figure 1:
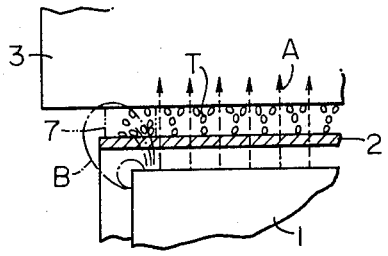
FIG. 1 is a partial view of a conventional sleeve-type developing unit.
Figure 2:
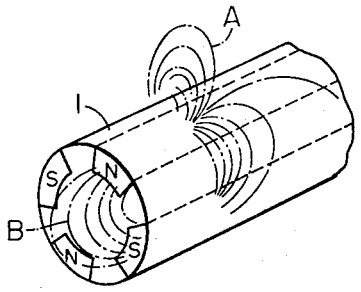
FIG. 2 is a partial perspective view of a conventional magnetic roller.

The above-mentioned two factors cause the development outside the image area b, thus leading to unnecessary waste of toner, and give rise to stain in the charging device, particular in the charging wire thereof, and a high load to the cleaning unit. Consequently there has conventionally been employed, as shown in FIG. 1, an elastically compressible seal member 7 provided between the sleeve 2 and the photosensitive member 3 to prevent the aforementioned spreading of toner and the development outside the image area. However the conventional magnet roller, having magnetic poles parallel to the axis of said roller as shown in FIG. 1, lacks the ability to prevent the toner scattering. For this reason the toner particles tend to enter the gap between the photosensitive member 3 and said seal member 7, melted by the heat of friction between said two members and solidified in said gap when the copier function is terminated, thus leading to undesirable effects such as damage on the photosensitive member in the succeeding copier operation. In order to prevent such drawbacks it has been proposed to prepare the seal member with a hard material or an easily deformable material thereby increasing the contact pressure on the photosensitive member and improving the sealing ability. Such solution, however, is defective in that there is required a higher drive torque for the photosensitive member.

According to the present invention, the magnetic displacement of the toner particles from the end portions toward the internal portion avoids the need for preventing the toner scattering by said seal member, whereby said seal member may be totally dispensed with or provided with a lower pressure on the photosensitive member to prevent the aforementioned drawbacks. Also the above-mentioned non-magnetic sleeve 10 may be realizes in the form of a belt.

Figure 6:
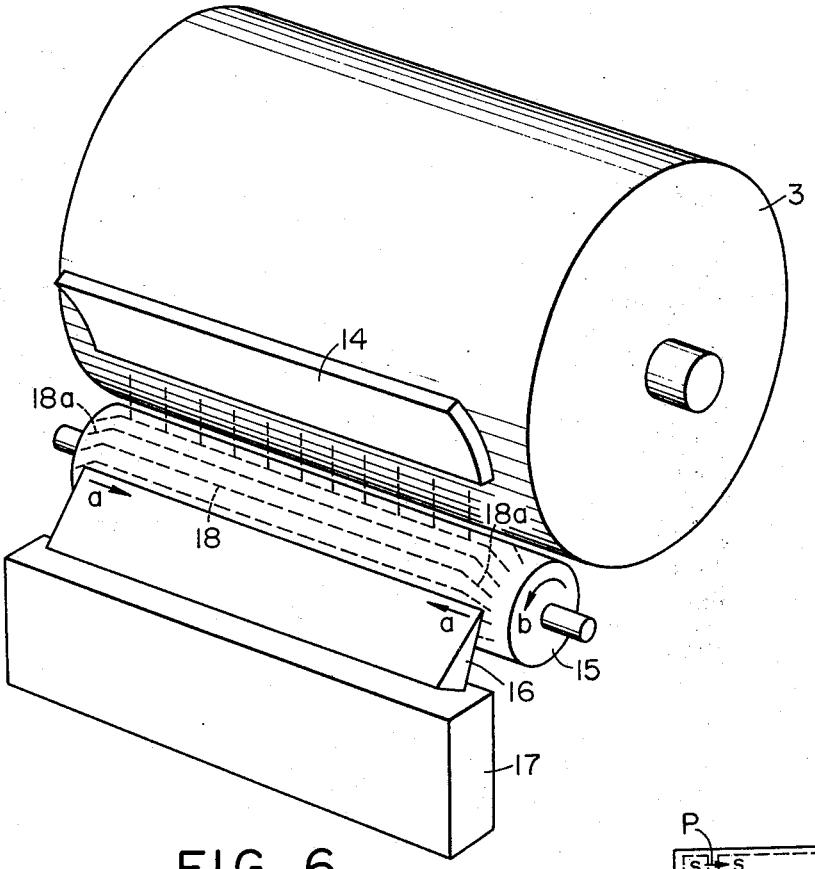
FIG. 6 is a perspective view of another embodiment of the present invention applied to the cleaning unit.

FIG. 6 shows another embodiment of the present invention applied to a cleaning unit for use in an electrophotographic or magnetographic apparatus.

There is shown a cleaning blade 14 to be maintained in contact with the surface of a latent image carrying member 3 for scraping off the remaining toner particles thereon. The toner particles thus scraped off or floating in the air are collected by a magnet roller 15 positioned under said blade, and then are scraped from said roller 15 by a non-magnetic scraper 16 maintained in contact with the surface of said roller for recovery in a box 17.

Said magnet roller 15 is structured longer, by 20 to 30 mm, then the image area while said scraper 16 is made somewhat shorter than said magnet roller 15. The magnetic poles 18 on said roller 15 are aligned parallel to the axis of the roller over the major portion of the length thereof but are bent, at positions 5 to 10 mm distant from the end faces of said scraper 16, into a direction with respect to the axis thereof to form inclined portions **18*a***.

In the conventional magnet roller wherein the magnetic poles are aligned over the entire length thereof parallel to the axis of the roller, the toner particles present on the magnet roller is spread in the lateral directions on the peripheral surface thereof upon contact with the scraper 16. Such spreading, taking place also in the end portions of the roller, tends to release the toner particles from the end faces of the roller, thus leading to the toner scattering, and thus requires mechanical seal means as explained in the foregoing.

In the present embodiment, however, the toner particles are transported toward the internal area of the roller as shown by the arrow a since the inclined portions **18*a* are displaced, upon rotation of the magnet roller, as if they move toward the center of the roller on the contact line between the scraper 16 and the magnet roller 15**. In this manner it is rendered possible to prevent the aforementioned release of toner particles from the magnet roller with a simple mechanism.

In the event, however, the accumulated height of the toner particles scraped off by the scraper 16 exceeds a half of the distance between the magnetic poles in said inclined portions, the particles may be inversely displaced to the outside under the influence of the succeeding magnetic pole. For this reason the distance between the magnetic poles should be selected sufficiently large with respect to the quantity of toner to be scraped off.

The embodiment shown in FIG. 6 is composed solely of the magnet roller. Such transporting device is naturally applicable also in the developing unit as shown in FIGS. 3 and 4. Inversely the toner transporting means for the cleaning unit may be provided with a non-magnetic sleeve.

Figure 7:
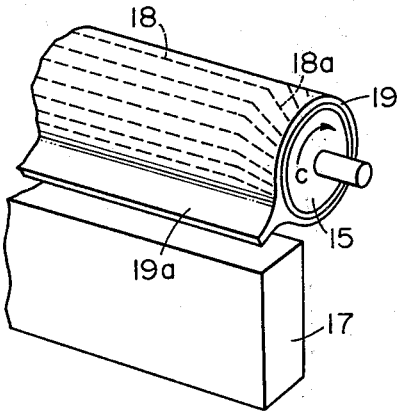
FIG. 7 is a partial perspective view of another embodiment of the transport means.

FIG. 7 is a partial perspective view of another embodiment of the toner transporting means having a sleeve, in which the same members as in FIG. 6 are represented by same numbers. The magnet roller 15 is covered by a non-magnetic sleeve 19 made for example of a synthetic resin. Said sleeve 19 is provided with an integral projecting portion **19*a* functioning as a scraper. In response to the rotation of the magnetic roller 15, the toner particles displace in the opposite direction on the sleeve 19 as explained in the foregoing and released, upon arrival at said projecting scraper portion 19*a*, from the magnetic field of the magnet roller to be recovered in a box 17. The direction of rotation of the roller 15 in the presence of the sleeve (FIG. 7) is opposite to that in the absence thereof (FIG. 6**) since, in the presence of the sleeve, the toner particles present thereon are displaced in a direction opposite to the rotating direction of the magnet roller.

Figure 8:
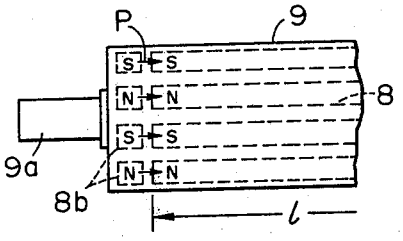
FIGS. 8 and 9 are partial plan views showing modifications of the magnet roller.
Figure 9:
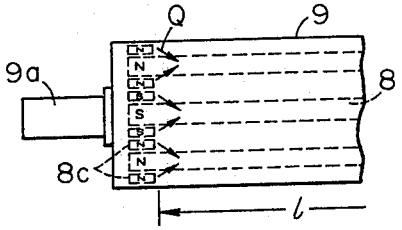

FIGS. 8 and 9 show two variations of the magnet roller in the sleeve-type magnetic powder transporting device shown in FIG. 3, wherein the same components as in FIG. 3 are represented by same numbers. In this case there are provided auxiliary magnetic poles **8*b* functioning complimentary to the principal magnetic poles aligned perpendicular to the displacing direction of the toner particles, said auxiliary poles being of same polarities as those of the principal poles but of lower field strength, and being positioned in alignment with said principal poles but separate therefrom. In such arrangement the toner particles present in the positions corresponding to such auxiliary poles are subjected to an axial force toward the center of the roller as represented by the arrow P in FIG. 8**, whereby the toner leaking from the end faces can be substantially prevented.

In FIG. 9 there are provided paired auxiliary magnetic poles **8*c*, in an area between the adjacent principal magnetic poles extending beyond the image area b and outside said image area b, of respectively same polarities as said adjacent principal poles but of lower field intensity, whereby the toner particles present in the corresponding positions being subjected to a force toward the center of the magnet roller 9 as represented by the arrow Q in FIG. 9**. In this manner the toner leading from the end faces can be substantially prevented.

As explained in the foregoing, the present invention enables the magnetic powder transportation without the leak thereof from the end portion of the magnetic field of the transport means, thus avoiding the spoiling of the apparatus by the magnetic powder. The present invention is extremely useful in the application in the sleeve-type developing unit and the cleaning unit of an electrophotographic copier, as the toner scattering can be prevented by a simple structure such as the deformation of the principal magnetic poles at the end portions thereof or the addition of auxiliary magnetic poles at said end portions.

I claim:

1. A transporting device for transporting magnetic powder with magnetic force, comprising:

transport means provided with a magnet having principal magnetic poles for transporting the magnetic powder; and drive means for driving said transport means, wherein said magnet has magnetic field generating portions provided at the end portions thereof for displacing the magnetic powder toward the internal portions of the magnet by magnetic force, said magnetic field generating portions being composed of a part of each of said principal magnetic poles, and wherein each said part is inclined with respect to the remaining part of each of said principal magnetic poles.

2. A transporting device for transporting magnetic powder with magnetic force, comprising:

transport means provided with a magnet having principal magnetic poles for transporting the magnetic powder; and drive means for driving said transport means, wherein said magnet has magnetic field generating portions provided at the end portions thereof for displacing the magnetic powder toward the internal portions of the magnet by magnetic force, said magnetic field generating portions being composed of auxiliary magnetic poles separate from said principal magnetic poles and having the same polarities as the principal poles with which they are associated.

3. A transporting device according to claim 2, wherein said auxiliary magnetic poles are of lower field intensity than, and are positioned in a spaced relation from, said principal magnetic poles at the end portions thereof.

4. A transporting device according to claim 2, wherein said auxiliary magnetic poles are paired and have the same polarities as those of corresponding principal magnetic poles but are of lower field intensity and are positioned between said corresponding principal poles at the end portions thereof.

5. A transporting device according to any of the preceding claims 1 to 4, wherein said magnet is adapted to transport the magnetic powder in a developing unit for the development of a latent images with the magnetic powder.

6. A transporting device according to any of the preceding claims 1 to 4, wherein said magnet is adapted to transport the magnetic powder in a cleaning unit for removing the magnetic powder remaining on a latent image carrying member.

7. A transporting device according to any of the preceding claims 1 to 4, wherein said transport means includes a non-magnetic member encircling said magnet device and rendered movable with respect thereto.

8. A transporting device according to claim 7, wherein said magnet is adapted to transport the magnetic powder in a developing unit for developing a latent image with the magnetic powder.

9. A transporting device according to claim 7, wherein said transport means includes a scraper positioned in facing relationship to said non-magnetic member.

10. A transporting device according to claim 9, wherein said magnet is adapted to transport the magnetic powder in a cleaning unit for removing the magnetic powder from a latent image carrying member.

11. A transporting device according to claim 10, wherein said scraper is integrally formed with said non-magnetic member.

12. A transporting device according to any of the preceding claims 1-4, wherein said magnet is mounted for rotation, and wherein said transport means includes a fixed scraper positioned in facing relationship with said rotary magnet.

13. A transporting device according to claim 12, wherein said magnet is adapted to transport the magnetic powder in a developing unit for developing a latent image with the magnetic powder.

14. A transporting device according to claim 12, wherein said magnet is adapted to transport the magnetic powder in a cleaning unit for removing the magnetic powder from a latent image carrying member.

* * * * *

UNITED STATES PATENT AND TRADEMARK OFFICE

CERTIFICATE OF CORRECTION

PATENT NO. : 4,297,969

DATED : November 3, 1981

INVENTOR(S) : AKIYOSHI TORIGAI

It is certified that error appears in the above-identified patent and that said Letters Patent are hereby corrected as shown below:

Column 4, line 68, "may be realizes" should read --may be realized--.

Column 5, line 13, "then" should read --than--;
line 33, "arrow a" should read --arrow a--.

Column 6, line 27, "being" should read --are--.

Column 7, line 22, "images" should read --image--.

Signed and Sealed this

*Ninth* Day of *March 1982*

[SEAL]

*Attest:*

GERALD J. MOSSINGHOFF

*Attesting Officer*

*Commissioner of Patents and Trademarks*